US009587355B2

(12) United States Patent
Bertrand et al.

(10) Patent No.: US 9,587,355 B2
(45) Date of Patent: Mar. 7, 2017

(54) METHOD OF MANUFACTURING GLASSINE PAPER

(71) Applicant: MUNKSJÖ OYJ, Helsinki (FI)

(72) Inventors: Jean-Francois Bertrand, Lalinde (FR); Marco Ruffino, Cirie (IT)

(73) Assignee: Munksjö Oyj, Helsinki (FI)

( * ) Notice: Subject to any disclaimer, the term of this patent is extended or adjusted under 35 U.S.C. 154(b) by 10 days.

(21) Appl. No.: 14/649,817

(22) PCT Filed: Dec. 2, 2013

(86) PCT No.: PCT/FI2013/051123

§ 371 (c)(1),
(2) Date: Jun. 4, 2015

(87) PCT Pub. No.: WO2014/091071

PCT Pub. Date: Jun. 19, 2014

(65) Prior Publication Data

US 2016/0017543 A1 Jan. 21, 2016

(30) Foreign Application Priority Data

Dec. 12, 2012 (FI) ..... 20126292

(51) Int. Cl.
*D21H 23/42* (2006.01)
*D21H 27/06* (2006.01)
(Continued)

(52) U.S. Cl.
CPC ..... *D21H 27/42* (2013.01); *D21H 19/84* (2013.01); *D21H 23/56* (2013.01); *D21H 25/14* (2013.01); *D21H 27/001* (2013.01); *D21H 27/06* (2013.01)

(58) Field of Classification Search
CPC ..... D21H 25/14; D21H 21/16; D21H 27/001; D21H 27/06; D21H 27/42; D21H 19/84;
(Continued)

(56) References Cited

U.S. PATENT DOCUMENTS 1,921,540 A * 8/1933 Richter ..... D21H 27/06 162/100
2,211,348 A 8/1940 Nelson
(Continued)

FOREIGN PATENT DOCUMENTS

GB 551950 A 3/1943
GB 1471576 A 4/1977
(Continued)

OTHER PUBLICATIONS

International Search Report(ISR) and Written Opinion(WO) for parent PCT application PCT/FI2013/051123 dated May 23, 2014.
(Continued)

*Primary Examiner* — Jose Fortuna
(74) *Attorney, Agent, or Firm* — Tech Valley Patent, LLC; John Pietrangelo

(57) ABSTRACT

Invention relates to a method of manufacturing glassine paper comprising following steps of producing paper by forming a paper web in a forming section and drying the web in a press section and in a pre-drying section; applying film-forming product on both sides of the web; removing moisture from the film-forming product in an after-drying section; passing the web having film-forming product on its surfaces through an on-line calendering process; and reeling up the glassine paper.

20 Claims, 4 Drawing Sheets

(51) Int. Cl.

| | |
|---|---|
| ***D21H 27/42*** | (2006.01) |
| ***D21H 23/56*** | (2006.01) |
| ***D21H 25/14*** | (2006.01) |
| ***D21H 27/00*** | (2006.01) |
| ***D21H 19/84*** | (2006.01) |

(58) Field of Classification Search
CPC ..... D21H 23/56; D21H 25/04; D21H 23/24; D21H 25/06; D21F 11/00; D21G 9/0036
See application file for complete search history.

(56) References Cited

U.S. PATENT DOCUMENTS 2,304,287 A * 12/1942 Schur ..... D21H 19/826 427/395
2,635,509 A 4/1953 Cowie et al.
2,792,765 A * 5/1957 Kerridge ..... D21B 1/12 162/141
3,989,416 A * 11/1976 Louden ..... D21H 17/34 427/361
6,193,840 B1 * 2/2001 Elijoki ..... D21F 5/04 162/136
6,200,424 B1 * 3/2001 Saari ..... D21G 1/00 100/38
6,207,020 B1 3/2001 Anderson
6,264,792 B1 7/2001 Kuosa et al.
6,412,189 B1 * 7/2002 Pellinen ..... D21F 7/008 34/114
6,426,120 B1 * 7/2002 Stocq ..... C09J 7/048 427/387
6,428,655 B1 * 8/2002 Kerttula ..... D21F 5/00 162/289
6,449,874 B2 * 9/2002 Pellinen ..... D21F 7/008 34/114
6,699,362 B1 * 3/2004 Rautiainen ..... D21F 9/003 162/125
6,863,919 B1 * 3/2005 Maenpaa ..... D21F 5/00 427/382
6,881,301 B2 * 4/2005 Heikkinen ..... D21G 1/00 100/162 R
8,261,465 B2 * 9/2012 Mayer ..... D21G 1/0093 118/100
9,322,135 B2 * 4/2016 Pietikainen ..... D21H 25/04
2001/0029682 A1 * 10/2001 Pellinen ..... D21F 7/008 34/452
2003/0089248 A1 * 5/2003 Linnonmaa ..... D21G 1/0093 100/161
2004/0005341 A1 * 1/2004 Dixit ..... C08L 29/04 424/401
2004/0025720 A1 * 2/2004 Heikkinen ..... D21G 1/00 100/327
2004/0060676 A1 * 4/2004 Gron ..... D21F 5/00 162/123
2005/0011624 A1 1/2005 Korhonen et al.
2005/0089641 A1 * 4/2005 Fors ..... D21H 19/82 427/365
2005/0126729 A1 * 6/2005 Koskinen ..... D21G 1/00 162/135
2005/0144802 A1 * 7/2005 Mayer ..... D21G 7/00 34/61
2006/0075961 A1 * 4/2006 Pullinen ..... D21G 7/00 118/255
2006/0131303 A1 * 6/2006 Trochlil ..... D21H 17/11 219/730
2008/0248318 A1 * 10/2008 Fry ..... D21H 27/001 428/454
2011/0104427 A1 5/2011 Suzuki
2012/0094101 A1 * 4/2012 Tani ..... C08J 7/12 428/219
2012/0186766 A1 * 7/2012 Fassbender ..... D21H 17/09 162/181.3
2015/0136349 A1 * 5/2015 Pietikainen ..... D21H 25/04 162/206
2016/0017543 A1 * 1/2016 Bertrand ..... D21H 23/56 162/136
2016/0194831 A1 * 7/2016 Olkkonen ..... D21H 25/005 162/137

FOREIGN PATENT DOCUMENTS

JP 09217299 A * 8/1997
WO 2005046312 A2 5/2005
WO 2005078194 A1 8/2005

OTHER PUBLICATIONS

Chapter II Demand and Response to Written Opinion for parent PCT application PCT/FI2013/051123 filed by Applicant dated Oct. 8, 2014.
Written Opinion(WO) from IPEA/EPO for parent PCT application PCT/FI2013/051123 dated Dec. 23, 2014.
International Preliminary Report on Patentability (IPRP) for parent PCT application PCT/FI2013/051123 dated Apr. 15, 2015.
"Papermaking" Brochure, SCA, 2010.
Gosh, Ajit,K., "Fundamentals of Paper Drying-Theory and Application from Industrial Perspective," Chapter 25 in "Evaporation, Condensation and Heat Transfer," A. Ahsan, ed., pp. 535-582, 2011.
Glatfelter, Product description: "Glassine Paper," www.glatfelteroberschmitten.de/spopergamynpergaminglassine.en.html, accessed Oct. 14, 2016.

* cited by examiner

METHOD OF MANUFACTURING GLASSINE PAPER

CROSS-REFERENCE TO RELATED APPLICATIONS

This application is a U.S. national phase application of International Application No. PCT/FI2013/051123 filed on 2 Dec. 2013, which designated the U.S., and which claims priority to Finnish Patent Application No. 20126292 filed on 12 Dec. 2012. The contents of each of these applications are hereby incorporated by reference in their entirety in this application.

BACKGROUND ON THE INVENTION

Technical Field

The invention relates to a method of manufacturing of glassine paper.

Background Art

Glassine release base paper is a special paper grade which strongly distinguish from common bulk grades such as newsprint paper, supercalendered uncoated magazine paper (SC-paper) and coated magazine paper printing paper (LWC, MFC).

Typically the glassine paper is produced so that the base paper including the surface closing with film-forming products is manufactured in a paper machine and is reeled up as machine rolls. Commonly the base paper is dried and then remoisturized to the level needed for super calendaring. The moisture content in the base paper is typically is very high, about 15-20% of the solid contents of the paper. Due to the drying and re-moisturizing the paper cross directional moisture content profile becomes substantially even. The machine rolls are stored at least 2 hours, in order to even out of the moisture left in the paper. After the moisture has stabilized the base paper is treated in an off-line supercalender in order to provide desired properties of the glassine paper.

As an example of such an off-line supercalender solution it is referred to document JP2009-155758A.

The standard manufacturing process has several drawbacks. For example, it requires a process involving two separate steps; the paper machine and the super calender. In some cases it may be required that there are even two separate super calenders per one paper machine in order that the super calendering process can follow the machine production as the calendering speed is lower than the paper machine speed. This increases space requirement and also investment costs. Additionally, the intermediate stage for evening out the moisture in the paper consumes time, requires additional human resources and makes the process more complex. In view of the above prior art, it is the object of the invention to provide an improved method of manufacturing of glassine paper with properties meeting at least the values described above, which improved the efficiency of the prior art manufacturing process.

DISCLOSURE OF THE INVENTION

With regard to the method, this object is met with a method of manufacturing of glassine paper comprising following steps of paper by forming a paper web in a forming section and drying the web in a press section and in a pre-drying section; applying film-forming product on both sides of the web; removing moisture from the film-forming product in an after-drying section; passing the web having film-forming product on its surfaces through an on-line calendering process; and reeling up the glassine paper.

According to an embodiment of the invention calendering process comprise calendering process comprises calendering treatment in several successive nips in at least one multi-nip calender.

According to an embodiment of the invention calendering process comprises at least a first calendering treatment in a first calendering section and a second calendering treatment in a second calendering section.

According to another embodiment of the invention calendering process comprises controlling web tension between the first and the second calendering treatment.

According to another embodiment of the invention calendering process comprises application of water by condensing steam onto the web before passing the web to anyone of the calendering sections.

According to another embodiment of the invention calendering process comprise cooling of the paper web and application of water by condensing steam onto the web before passing the web to anyone of the calendering sections.

According to still another embodiment of the invention calendering process comprise application of water by condensing steam onto the web before passing the web to anyone of the calendering sections.

According to still another embodiment of the invention calendering process comprises at least a first calendering treatment in a first calendering section and a second calendering treatment in a second calendering section and the first calendering treatment comprises treating the paper web in at least four successive calendering nips.

According to still another embodiment of the invention the second calendering treatment comprises treating the paper web in at least two successive calendering nips.

According to still another embodiment of the invention removing moisture from the film-forming product in an after-drying section comprises a step of controlling moisture CD profile of the web by transferring heat adjustably in CD direction while drying the web; and wherein controlling moisture CD profile is based on the moisture content profile of the web entering the calendering treatment.

According to still another embodiment of the invention removing moisture from the film-forming product in an after-drying section comprises a step of controlling moisture CD profile of the web by transferring heat adjustably in CD direction while drying the web; and wherein controlling moisture CD profile is based on the moisture content profile of the web before the reel-up.

According to still another embodiment of the invention removing moisture from the web in the pre-drying section and applying film-forming product on both sides of the paper comprises a step of controlling moisture CD profile of the web by transferring heat adjustably in CD direction to the web at the press section; and wherein controlling moisture CD profile is based on the moisture content profile of the web before film application and/or impregnation system.

According to still another embodiment of the invention drying the web by a press section comprises a step of controlling moisture CD profile of the web by transferring heat adjustably in CD direction to the web prior to entering into a press nip; and wherein controlling moisture CD profile is based on the moisture content profile of the web entering the process of applying film-forming product on both sides of the base paper.

According to an embodiment of the invention the film-forming product is selected from a group comprising starch, polyvinyl alcohol, carboxymethyl cellulose, alginate or any other product.

According to still another embodiment of the invention wherein the applying the film-forming product is practiced in a size-press, film press or any other coating/impregnating system.

According to still another embodiment of the invention the temperatures of the surface of the heating cylinders are controlled to be from 170 to 240° C. and nip loads of the first calendering section and the second calendering section are controlled to be 270-400 kN/m.

According to an embodiment of the invention the temperatures of the surface of the heating cylinders are controlled to be from 170 to 240° C. and nip loads of the first calendering section and the second calendering section are controlled to be about 300 kN/m.

According to still another embodiment of the invention a target calendering process moisture content is set for the web and wherein the target moisture content of the web is achieved by drying the web in the after-drying section. This provides the effect that the web after the after-drying section is as such suitable for calendering in respect of its moisture content and thus no additional steam moisturizing is needed.

Advantageously the after-drying section is operated so that the target calendering moisture content is obtained by increasing web moisture content up to a point where the target moisture content is achieved.

According to still another embodiment of the invention the web is further dried in a post-calendering drying section resulting in final moisture content.

According to still another embodiment of the invention the calendering process is performed at elevated moisture content and the web is dried in a post-calendering drying section resulting in final moisture content.

According to still another embodiment of the invention the web is subjected to drying with cylinders having their surface roughness selected so that the surface quality obtained in the preceding calendering process will be remained or improved.

The present invention provides several benefits compared to prior art method of producing glassine paper, of which only few are mentioned.

By means of the invention it is possible to manufacture glassing paper which has excellent properties. At least an equivalent densification is reached with a lower calendering activity, with smaller number of nips and lower nip load meaning e.g. less energy consumption. Also evaporation rate needed during the calendering phase is smaller than in prior art solutions.

The present invention results in continuous process without a need of having separate machines and storage space to provide needed density of the paper. Consequently the present invention provides more effective overall process.

In this context the Glassine grade is defined as follows. Glassine is a very dense, highly resistant and smooth paper, and it is air, water and oil resistant. Typically the lower grammages (40 to 65 g/m$^2$) are designed to be translucent. Typical properties for glassine paper are obtained by a high level of fiber refining, surface closing with film-forming products and calendering. Glassine is used for example as base for release liner because it is suitable for silicone coating. Glassine has to be chemically compatible with the silicone for insuring a proper curing and anchorage of the silicone coating. Glassine may be manufactured from 40 to 150 g/m$^2$ and is typically used as base of release liner for self-adhesive material and label.

As an example, in the case of base of release liner for self-adhesive label, the usual specifications required by the market for converting and processing in the application are as follows.

| | |
|---|---|
| Density: Grammage (ISO536)/Thickness (ISO534) | Typical values between 1.1 and 1.2 |
| Smoothness of side to be silicone coated (ISO 5627) | 900 sec min |
| Transparency (ISO 2470) | 48% min |
| Rizinus Cobb absorption (ISO 535) | 1.1 g/m$^2$ max |
| Thickness standard deviation (ISO 534) | 2.0 μm max |
| Porosity (ISO 11004) | <15.000 pm/Pas |
| Breaking length (ISO 1924) | minimum 9.15 Km |
| Release forces at given conditions (coatweight: 1 g/m$^2$) FTM 4 (TESA TAPE 7475) | @ 10 m/min <50 g<br>@ 300 m/min <90 g |

BRIEF DESCRIPTION OF DRAWINGS

In the following, the invention will be described with reference to the accompanying exemplary, schematic drawings, in which.

DETAILED DESCRIPTION OF DRAWINGS

Figure 1:
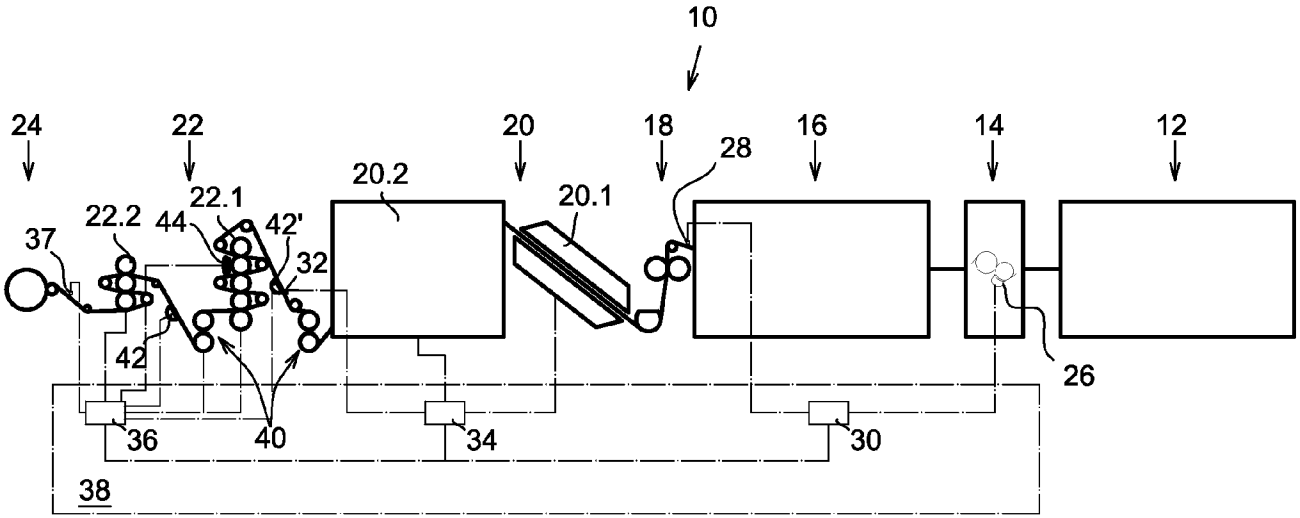
FIG. 1 shows a paper machine for manufacturing of glassine paper according to an embodiment of the invention.

FIG. 1 shows a paper machine 10 which comprises in successive order i.e. in a running direction of the web, a forming section 12, a press section 14, a first or a pre-drying section 16, a film application and/or impregnating system 18, such as a size-press or film press, a second or an after-drying section 20, a calendering section 22 and a reel-up 24. The forming section 12, the press section 14, and the pre-drying section 16 and their operation are known as such by a skilled person in the art.

A base paper for glassine paper is manufactured by forming a paper web in a forming section 12 and drying the web in a press section 14 and in a pre-drying section 16. The paper machine further comprises a steam box 26 arranged in connection with the press section. The steam box 26 is arranged to apply heat controllably in cross direction (later CD) to the web effecting on the removal of the water from the web. The operation of the steam box 26 is controlled based on CD moisture profile measured after the pre-drying section 16 and before the film application and/or impregnating system 18 by a measurement frame 28. The purpose is to provide CD moisture profile as even as possible so that the average CD moisture content is within a range of 2 to 7%. The term moisture content means a percentage of ratio of water weight to the weight of the web. This provides advantageous circumstances for the next step, in which a film forming product, which advantageously is for example a water based solution of starch, polyvinyl alcohol, carboxymethyl cellulose, alginate or any other suitable product and/or mixture thereof, is applied on both sides of the base paper in the film application and/or impregnating system 18 following the pre-drying section 16. The actual composition of the film forming product may be the same for both sides of the base paper, or alternatively different film forming product may be applied to each side of the paper. This provides the effect of resulting in good distribution of the film-forming product in the size press. There is a controlling unit 30 which is arranged to perform the above mentioned control procedure in order to practice the method.

Subsequently the web having its both surfaces applied with the film forming product is passed through the after-drying section 20. The web and/or the applied film forming product is dried in the after-drying section 20. The after drying section comprises a first drying section 20.1 and a second drying section 20.2, at least one of which is capable of controlling moisture CD profile of the web by transferring heat adjustably in CD direction while drying the web. Advantageously the first drying section is a contactless dryer, such as an infra-red dryer, which makes it possible to control the moisture CD profile of the web by transferring heat adjustably in CD direction very efficiently.

In the embodiment of FIG. 1 the infra-red dryer, preceded by a contactless air operated web guiding device, allows the applied film forming product to be dried enough before the web is brought into contact with any solid surface. The second drying section 20.2 is advantageously a cylinder dryer having steam and/or hot oil heated cylinders. The operation of the first 20.1 and the second dryer part 20.2 is controlled based on CD moisture profile measured after the after-drying section 20 and before the calendering treatment section 22 by a measurement frame 32. The first dryer part 20.1 is operated so that it generally dries the web and/or the applied film forming product and additionally transfers heat to the web so that moisture CD profile may be controlled. The second dryer part 20.2 must not include such profile control capability. Again, the purpose is to provide web CD moisture profile as even as possible at an average CD moisture content range of 6-10%, advantageously about 8% before the calendering treatment section.

Operating the after-dryer accordingly provides most effective control of densification of the web in the successive calendering treatment. There is a controlling unit 34 which is arranged to perform the above mentioned control procedure in order to practice the method. After the second dryer part 20.2 and before the first calendering section 22.1 there is a web cooling section 40, which here comprises two cooling cylinders. The cooling section 40 is used as a cooling stage. The web is cooled so that, when the web is subjected to steam application stage 42' after the cooling, the water applied as steam is condensed on the surface of the web.

After the base paper and the applied film forming product has been dried in the after-drying section 20 and, if desired and/necessary, moisturized in the steam application stage 42', it is passed through an on-line calendering treatment section 22 in which calendering process is practiced. The calendering treatment section 22 comprises a first calendering section 22.1 in which the paper web is subjected to first calendering treatment, and a second calendering section 22.2 in which the paper web is subjected to second calendering treatment. Between the first and the second calendering sections there is also a web cooling section 40, which advantageously comprises cooling cylinders. The cooling section 40 is used as a cooling stage. In the embodiment of FIG. 1 there are two successive cooling cylinders. Moisture content of the web coming from the first calendering section is at about 5-6%. Now, the web is cooled by the web cooling section so that, when the web is subjected to steam application stage 42 after the cooling, the water, which is applied as steam is condensed on the surface of the web. Preferably the web temperature after the cooling is below 47° C. But, in case the cooling capacity makes it possible, the web temperature may be cooled down to even lower temperature. The steam application stage may be also referred to as a steam moisturizer. According to an embodiment of the invention there may be another steam moisturized between the first calendering section and after the second dryer part 20.2. The total increase of the moisture content of the web by the steam moisturizer(s) is in the range of 2-3%. This added moisture is evaporated by the calendering process so that the moisture content of the paper at the reel-up is about 6-5%.

The first calendering section 22.1 comprises a roll stack of a multi-nip calender in which several nips are arranged, advantageously four successive nips. Accordingly, the first calendering treatment according to the invention comprises treating the paper web in at least four successive calendering nips. In order to result in the desired quality of the glassine paper the temperatures of the heating cylinders are controlled to be between 170-240° C., and nip loads of the first calendering section are controlled to be 270-400 kN/m preferably about 300 KN/m. The nips of the first calendering section are arranged to control mainly the CD thickness profile of the paper and to increase the desired quality of the glassine paper i.e. increase density and transparency of the paper. The CD thickness profile controlled by a heat transfer system 44 capable of heating a roll surface locally and adjustable manner in cross direction of the machine (longitudinal direction of roll). Advantageously the heat transfer system is an inductive heating system installed on the first steel cylinder of the calendering section. The operation of the heat transfer system is directly controlled by a thickness CD measurement arranged on a scanner 36.1 before the reel-up 24.

The second calendering section 22.1 comprises a stack of rolls in which at least two successive calendering nips are arranged. Accordingly, the second calendering treatment comprises treating the paper web in at least two successive calendering nips after the cooling stage and steam moisturizer. In order to result in the desired quality of the glassine paper the temperatures and nip loads of the second calendering section are controlled preferably so that the densification and smoothness are at the required levels. Accordingly, the second calendering treatment according to the invention comprises treating the paper web so that the temperatures of the heating cylinders are controlled to be between 170-240° C., and nip loads of the second calendering section are controlled to be 270-400 kN/m preferably around 300 KN/m.

Thus according to the invention the calendering section are both provided with multi-nip calenders having successive hard surface and soft surface rolls of which the hard surface rolls are heatable.

According to an embodiment of the invention the method comprises a step of controlling web tension between the first and the second calendering treatment and calendering sections. Controlling the web tension controls the tension of the web between the first and the second calendering treatment in separate calendering stacks makes it possible to effect on the smoothness of the paper by creating friction between the paper surface and the calender roll. Smoothness, on the other hand, is beneficial in further processing of the glassine paper, for example silicone coating. The web tension is provided by the speed difference between the first and the second calendering section.

There is a controlling unit 36 which is arranged to perform the above mentioned control procedure in order to practice the method controlling at least the operation of the first calendering section 22.1, second calendering section 22.2, web cooling section 40 and the steam moisturizer 42. The control units 30, 34 and 36 may be separate control units or they may be integral parts of a paper machine quality control system 38.

Since the moisturizer is a steam moisturize, the water will efficiently diffuse into the web, below its surface to inner structure of the web and provide increased densification of the web and smoothness. Increasing the moisture content of the web at the entrance of a calendering section increases also transparency and reduces oil absorption. These are the main indicators of good densification and siliconability. Additionally it is possible in some circumstances obtain good results with smaller nip loads in the calender.

A trial experiment that has been made by the inventors has shown that for example that standard deviation thickness value of the glassine paper (62 $g/m^2$) produced by the method according to the invention is less than 1.7 μm (typically max. 2.0 μm) which is far below the commercial requirements. Density value was about 1.1 $g/cm^3$ (typically 1.1-1.2 $g/cm^3$). Also excellent transparency of 50.9% (typically min 48%) was obtained.

Figure 2:
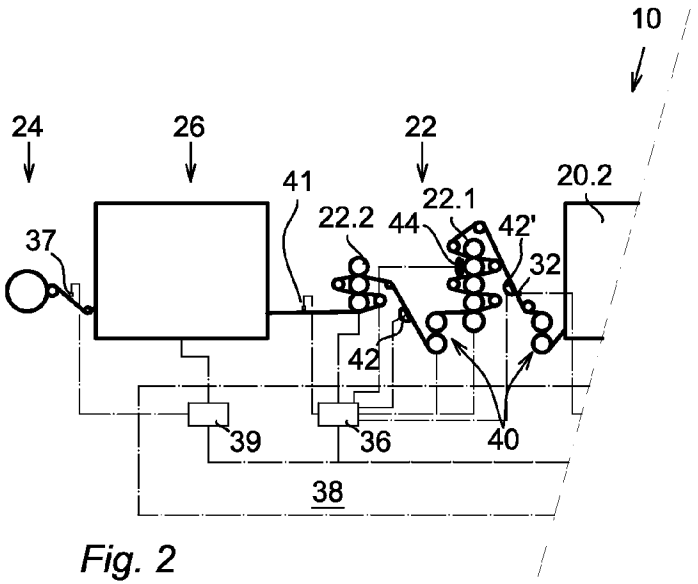
FIG. 2 shows a paper machine for manufacturing of glassine paper according to another embodiment of the invention.

FIG. 2 shows an embodiment of the invention. This embodiment comprises the paper machine 10 as shown in FIG. 1 with an exception that after the calendering treatment section 22 there is a post-calendering drying section 26 arranged between the calendering treatment section 22 and the reel-up 24. The post-calendering drying section 26 is operated so that it generally dries the web and/or the remaining moisture in the web. This allows usage higher moisture content levels of the web in the calendering process, which in turn improves particularly the densification. Densification of the web is important to the process of manufacturing the glassine paper. There is a controlling unit 39 which is arranged in connection with the second after-drying section 26. The paper machine's 10 control system may also comprise a web measurement frame 41 before the post calendering drying section in the web running direction. Otherwise the embodiment of FIG. 1 comprises corresponding elements and operates similarly to that of FIG. 1.

Figure 3:
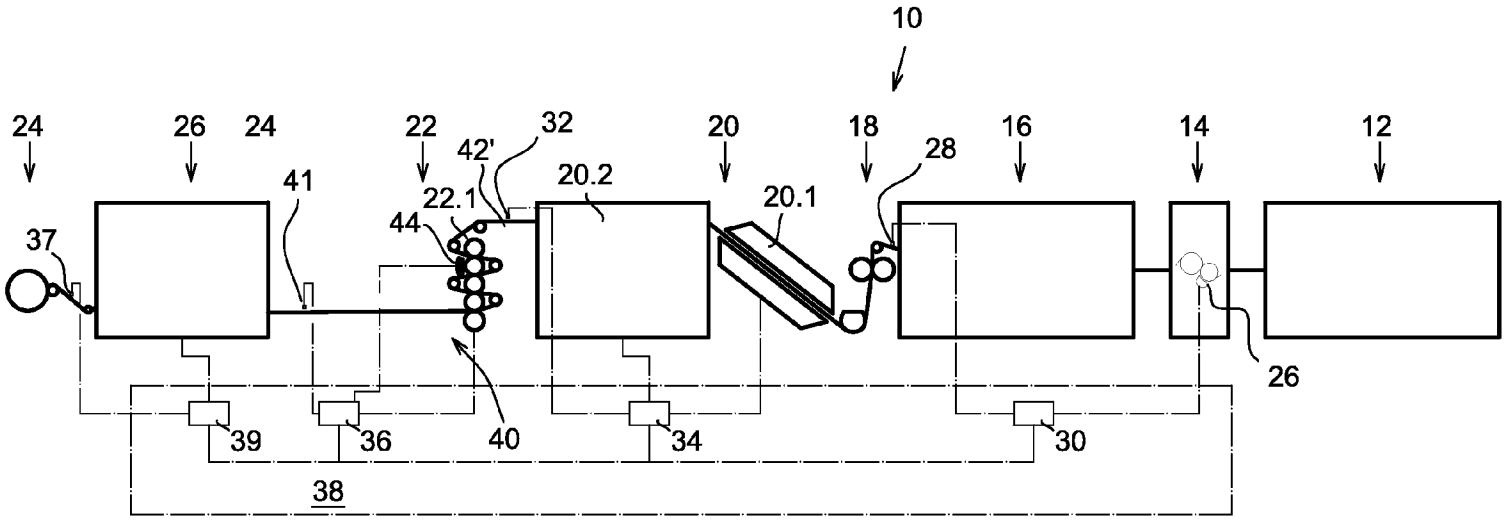
FIG. 3 shows a paper machine for manufacturing of glassine paper according to still another embodiment of the invention and FIG. 4 shows a calendering section of a paper machine for manufacturing of glassine paper according to still another embodiment of the invention.

FIG. 3 shows another embodiment of the invention. A paper machine 10 comprises in successive order i.e. in a running direction of the web, a forming section 12, a press section 14, a pre-drying section 16, a film application and/or impregnating system 18, an after-drying section 20, a calendering section 22, a post-calendering drying section 26 and a reel-up 24. The forming section 12, the press section 14, and the pre-drying section 16 and their operation are known as such by a skilled person in the art.

In this embodiment a base paper for glassine paper is manufactured by forming a paper web in a forming section 12 and drying the web in a press section 14 and in a pre-drying section 16. The paper machine further comprises a steam box 26 arranged in connection with the press section. The steam box 26 is arranged to apply heat controllably in cross direction to the web effecting on the removal of the water from the web in the press section. The operation of the steam box 26 is controlled e.g. based on CD moisture profile measured after the pre-drying section 16 and before the film application and/or impregnating system 18 by a measurement frame 28. The purpose is to provide CD moisture profile as even as possible at an average CD moisture content range of 2 to 7% after the pre-drying section. This provides advantageous circumstances for the next step, in which a film forming product is applied on both sides of the base paper in the film application and/or impregnating system 18. There is a controlling unit 30 in the paper machine 10 which is arranged to perform the above mentioned control procedure in order to practice the method.

Subsequently the web having its both surfaces applied with the film forming product is passed through the after-drying section 20. The after drying section comprises a first drying section 20.1 and a second drying section 20.2, at least one of which is capable of controlling moisture CD profile of the web by transferring heat adjustably in CD direction while drying the web. The web and/or the applied film forming product is dried in the after-drying section 20 while simultaneously controlling he CD moisture content of the web. Advantageously the first drying section is a contactless dryer, such as an infra-red dryer, which makes it possible to control the moisture CD profile of the web by transferring heat adjustably in CD direction very efficiently.

In the embodiment of FIG. 3 the infra-red dryer, preceded by a contactless air operated web guiding device, allows the applied film forming product to be dried enough before the web is brought into contact with any solid surface. The second drying section 20.2 is advantageously a cylinder dryer. The operation of the first 20.1 and the second dryer part 20.2 is controlled advantageously based on CD moisture profile measured after the after-drying section 20 and before the calendering treatment section 22 by a measurement frame 32. The first dryer part 20.1 is operated so that it generally dries the web and/or the applied film forming product and additionally transfers heat to the web so that moisture CD profile may be controlled i.e. heating is controlled to be more intensive at the CD locations where the web has more moisture. The second dryer part 20.2 must not include such profile control capability. Again, the purpose is to provide CD moisture profile as even as possible so that an average CD moisture content is within a range of 7-11%, advantageously about 9% before the calendering treatment section. In the method of manufacturing of glassine paper according to the embodiment of FIG. 3 a target calendering process moisture content is set for the web. The target calendering process moisture content is 7-11%, advantageously about 9%. It is monitored by a measurement frame 32 based on which the operation of the paper machine upstream in running direction of the web is controlled.

The second drying section 20.2 is controlled and operated so that the web coming out from the second drying section is at the target calendering moisture content or within an acceptable window. In other words the web is dried to the target calendering moisture content so that adding of additional water is not required. The target moisture is stored or made available to the controlling unit 34 which controls the operation of the second drying section 20.2. Thus, advantageously the after-drying section is operated so that the target moisture content for calendering process 22 is obtained by raising web moisture content only up to the point where the target moisture content is reached. This way there is no need to add additional water into the web i.e. the web is led from the after-drying section 20 to the calendering process without actively moisturizing the web.

Operating the after-dryer accordingly provides most effective control of densification of the web in the successive calendering treatment. The controlling unit 34 is arranged to perform the above mentioned control procedure in order to practice the method.

Thus, subsequently the base paper and the applied film forming product has been dried in the after-drying section 20 and, it is passed through an on-line calendering treatment section 22 in which calendering process is practiced. Even if the calendering treatment section 22 comprises in FIG. 3 only one calendering section 22.1 the actual physical composition may vary in the scope of the invention. For example, the calendering section may comprise two separate stacks, or event 3 or 4 stacks if so desired. In any case, the paper web is subjected to calendering treatment which provides the effect required by glassine paper.

The calendering section 22.1 comprises a roll stack of a multi-nip calender in which several nips are arranged. Accordingly, the calendering treatment according to the invention comprises treating the paper web in at least four successive calendering nips. In order to result in the desired quality of the glassine paper the temperatures of the heating cylinders are controlled to be between 170-240° C., and nip loads of the first calendering section are controlled to be 270-400 kN/m. The nips of the calendering section are arranged to control mainly the CD thickness profile of the paper and to increase the desired quality of the glassine paper i.e. increase density and transparency of the paper. The CD thickness profile controlled by a heat transfer system 44 capable of heating a roll surface locally and adjustable manner in cross direction of the machine (longitudinal direction of roll). Advantageously the heat transfer system is an inductive heating system installed on the first steel cylinder of the calendering section. The operation of the heat transfer system is directly controlled by a thickness CD measurement arranged on a scanner 37 before the reel-up 24 and/or the scanner 41 after the calendering section and/or the scanner 32 before the calendering section.

There is a controlling unit 34, 36 which is arranged to perform the above mentioned control procedure in order to practice the method controlling at least the operation of the calendering section 22.1, The control units 30, 34, 36 and 39 may be separate control units or they may be integral parts of a paper machine quality control system 38.

Since the target moisture is obtained only by drying the web, the water is advantageously manner distributed in the web, below its surface at inner structure of the web and provides increased densification of the web and smoothness. Maintaining the target moisture content of the web at the entrance of a calendering section increases also transparency and reduces oil absorption. These are the main indicators of good densification and siliconability. Additionally it is possible in some circumstances obtain good results with smaller nip loads in the calender.

A trial experiment that has been made by the inventors has shown that for example that standard deviation thickness value of the glassine paper (62 g/m$^2$) produced by the method according to the invention is less than 1.7 μm (typically max. 2.0 μm) which is far below the commercial requirements. Density value was about 1.1 g/cm$^3$ (typically 1.1-1.2 g/cm$^3$). Also excellent transparency of 50.9% (typically min 48%) was obtained.

After the calendering treatment section 22 there is a post-calendering drying section 26 arranged between the calendering treatment section 22 and the reel-up 24. The post-calendering drying section 26 is operated so that it generally dries the web and/or the remaining moisture in the web. This allows calendering at elevated moisture content i.e. usage higher moisture content levels of the web in the calendering process, which in turn improves particularly the densification. The elevated moisture content means such moisture content that calendering process alone will not evaporate all required amount of water from the web in order to meet the final moisture content for commercial product. Densification of the web is important to the process of manufacturing the glassine paper. There is a controlling unit 39 which is arranged in connection with the second after-drying section 26. The paper machine 10 control system may also comprise a web measurement frame 41 before the post calendering drying section in the web running direction.

In order to have the surface of the paper after calendering at desired quality and not degrade the surface, it is essential to have chromed drying cylinders in the post-calendering drying section 26 with very smooth surface (Roughness parameter Ra at least 0.1 μm) According to an embodiment of the invention the drying cylinder in the post-calendering section 26 have their roughness selected so that the surface quality obtained in the preceding calendering process will be remained or improved.

Figure 4:
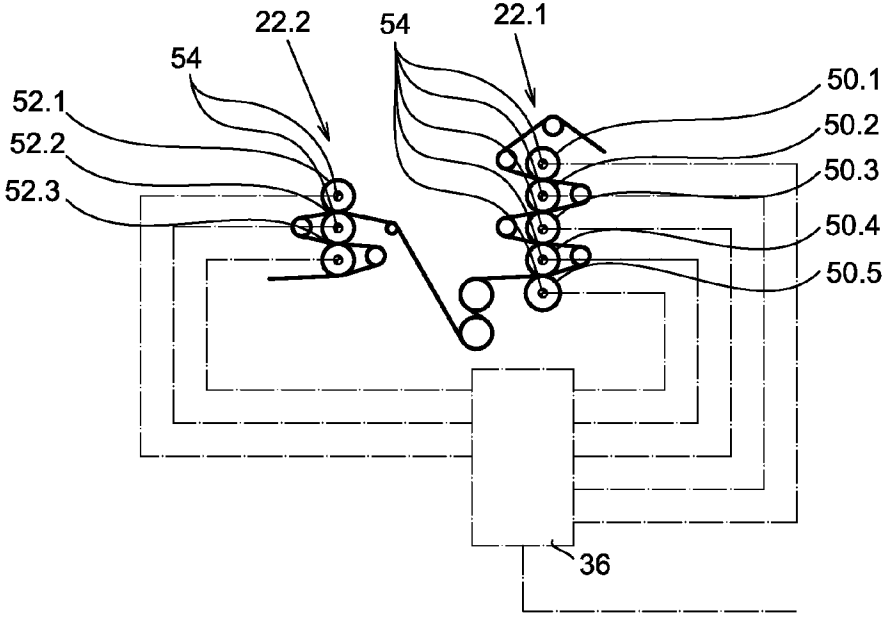

In FIG. 4 there is shown a part of a paper machine illustrating two successive calender sections 22.1 and 22.2 in more detailed manner. The operation of a calendering process comprising at least a first calendering treatment in which the paper web is subjected to first surface treatment in a first calendering section 22.1 and a second calendering treatment in which the paper web is subjected to second surface treatment in a second calendering section 22.2. Each of the calender rolls 50.1, 50.2, 50.3, 50.4, 50.5 of the first stack as well as the rolls 52.1, 52.2, 52.3 of the second stack is provided with a drive 54. Operation of each drive 54 is controlled by the controlling unit 36.

In successful calendering process the chain of successive treatments to which the paper is subjected is critical. According to an embodiment of the invention the speed of the rolls 52.1-52.3 of the second calender section is slightly higher than the speed of the rolls 50.1-50.5 of the first calender section. The speed differential creates a slip of the paper web in the nip between the first calender rolls, thus creating the friction phenomenon.

Thus, by controlling the speed (tension) of web after a stack 22.1 of calendar rolls 50.1-50.5 by the second stack 22.2 it is possible to have friction as a control parameter enhancing the smoothening effect of the cylinders of the calender.

While the invention has been described herein by way of examples in connection with what are, at present, considered to be the most preferred embodiments, it is to be understood that the invention is not limited to the disclosed embodiments, but is intended to cover various combinations or modifications of its features, and several other applications included within the scope of the invention, as defined in the appended claims. The details mentioned in connection with any embodiment above may be used in connection with another embodiment when such a combination is technically feasible.

The invention claimed is:

1. A method of manufacturing glassine paper comprising following successive steps of producing paper in a paper machine by forming a paper web in a forming section of the paper machine and drying the web in a press section of the paper machine and in a pre-drying section of the paper machine; applying film-forming product on both sides of the web in the paper machine; removing moisture from the film-forming product applied to the web in an after-drying section of the paper machine wherein moisture CD profile of the web is controlled by transferring heat adjustably in a CD direction while drying the web; passing the web having film-forming product through an on-line calendering process in a calendering treatment section of the paper machine, the on-line calendaring process comprising successive nips in at least one multi-nip calender where the CD thickness profile of the web is controlled and a density and a transparency of the web is increased; and reeling up the glassine paper in a reel-up of the paper machine.

2. A method of manufacturing glassine paper according to claim 1, wherein the online calendering process comprises at least a first calendering treatment in a first calendering section and a second calendering treatment in a second calendering section.

3. A method of manufacturing glassine paper according to claim 2, wherein the online calendering process further comprises controlling web tension between the first and the second calendering treatment.

4. A method of manufacturing glassine paper according to claim 2, wherein the first calendering treatment comprises treating the paper web in at least four successive calendering nips.

5. A method of manufacturing glassine paper according to claim 2, wherein the second calendering treatment comprises treating the paper web in at least two successive calendering nips.

6. A method of manufacturing glassine paper according to claim 1, wherein the online calendering process comprises application of water by condensing steam onto the web before passing the web to the calendering treatment section.

7. A method of manufacturing glassine paper according to claim 1, wherein the online calendering process comprises cooling the paper web and application of water by condensing steam onto the web before passing the web to the calendering treatment section.

8. A method of manufacturing glassine paper according to claim 1, wherein removing moisture from the film-forming product applied to the web in the after-drying section comprises a step of controlling moisture CD profile of the web by transferring heat adjustably in CD direction while drying the web; and wherein controlling moisture CD profile is based on a moisture content profile of the web entering the calendering treatment section.

9. A method of manufacturing glassine paper according to claim 1, wherein drying the web in the pre-drying section and applying film-forming product on both sides of the web comprises a step of controlling moisture CD profile of the web by transferring heat adjustably in CD direction to the web at the press section; and wherein controlling moisture CD profile is based on a moisture content profile of the web.

10. A method of manufacturing glassine paper according to claim 9, wherein drying the web in the press section comprises a step of controlling moisture CD profile of the web by transferring heat adjustably in CD direction to the web prior to entering into a press nip; and wherein controlling moisture CD profile is based on a moisture content profile of the web before applying film-forming product on both sides of the web.

11. A method of manufacturing glassine paper according to claim 1, wherein drying the web in the press section comprises a step of controlling moisture CD profile of the web by transferring heat adjustably in CD direction to the web prior to entering into a press nip; and wherein controlling moisture CD profile is based on a moisture content profile of the web before applying film-forming product on both sides of the web.

12. A method of manufacturing glassine paper according to claim 1, wherein the calendering treatment section comprises heating cylinders, the heating cylinders defining nips, and wherein a temperature of the heating cylinders are controlled to be 170-240° C., and a nip load of the calendering treatment section is controlled to be 270-400 kN/m.

13. A method of manufacturing glassine paper according to claim 1, wherein a target calendering process moisture content is set for the web and wherein the target calendering process moisture content of the web is achieved by drying the web in the after-drying section.

14. A method of manufacturing glassine paper according to claim 13, wherein the after-drying section is operated so that the target calendering process moisture content is obtained by increasing web moisture content up to a point where the target moisture content is achieved.

15. A method of manufacturing glassine paper according to claim 14, wherein the web is further dried in a post-calendering drying section resulting in a final moisture content.

16. A method of manufacturing glassine paper according to claim 14, wherein the web film-forming product comprises at least one of starch, polyvinyl alcohol, carboxymethyl cellulose, and alginate.

17. A method of manufacturing glassine paper according to claim 13, wherein the web is further dried in a post-calendering drying section resulting in a final moisture content.

18. A method of manufacturing glassine paper according to claim 17, wherein in the post-calendering drying section the web is subjected to drying with cylinders having surface roughness selected so that a web surface quality obtained in the preceding calendering process will be remained or improved.

19. A method of manufacturing glassine paper according to claim 1, wherein the on-line calendering process is performed at elevated moisture content, wherein the elevated moisture content comprises a moisture content wherein the on-line calendering process alone cannot evaporate sufficient water from the web to provide a final moisture content for a commercial product, and wherein the web is further dried in a post-calendering drying section resulting in the final moisture content.

20. A method of manufacturing glassine paper according to claim 1, wherein the CD thickness profile in the at least one multi-nip calender is controlled by a heat transfer system capable of heating a roll surface locally and in an adjustable manner in the CD direction.

* * * * *